United States Patent [19]

Bertelsen

[11] 4,402,823

[45] Sep. 6, 1983

[54] SUPPLEMENTAL PYROLYSIS AND FINES REMOVAL IN A PROCESS FOR PYROLYZING A HYDROCARBON-CONTAINING SOLID

[75] Inventor: Corey A. Bertelsen, Oakland, Calif.

[73] Assignee: Chevron Research Company, San Francisco, Calif.

[21] Appl. No.: 288,095

[22] Filed: Jul. 29, 1981

[51] Int. Cl.[3] ..... C10G 1/00; C10B 53/06

[52] U.S. Cl. ..... 208/11 R; 201/31; 201/32

[58] Field of Search ..... 208/8 R, 11 R; 201/31, 201/32, 12; 202/118

[56] References Cited

U.S. PATENT DOCUMENTS

| | | | |
|---|---|---|---|
| 2,626,234 | 1/1953 | Barr et al. | 208/11 R X |
| 3,167,494 | 1/1965 | Crawford | 208/8 |
| 3,252,886 | 2/1966 | Crawford | 208/11 R |
| 3,655,518 | 4/1972 | Schmalfeld et al. | 201/12 X |
| 3,784,462 | 1/1974 | Frick | 208/11 R |
| 4,054,492 | 10/1977 | Rammler et al. | 201/12 |
| 4,141,794 | 2/1979 | Choi | 208/11 R X |
| 4,183,800 | 1/1980 | Mitchell et al. | 208/8 |
| 4,199,432 | 4/1980 | Tamm et al. | 208/8 |

*Primary Examiner*—Delbert E. Gantz
*Assistant Examiner*—Glenn Caldarola
*Attorney, Agent, or Firm*—D. A. Newell; S. R. LaPaglia; J. W. Ambrosius

[57] ABSTRACT

In a process for pyrolyzing a particulate hydrocarbon-containing solid an improvement comprising removing entrained fines from the product vapors leaving the principal pyrolysis zone and pyrolyzing any remaining hydrocarbons in the fines in a supplemental pyrolysis zone.

5 Claims, 2 Drawing Figures

SUPPLEMENTAL PYROLYSIS AND FINES REMOVAL IN A PROCESS FOR PYROLYZING A HYDROCARBON-CONTAINING SOLID

BACKGROUND OF THE INVENTION

Certain naturally occurring materials contain a carbonaceous component which, upon heating, will release a hydrocarbon product which is useful as a feedstock in petroleum processing. These "hydrocarbon-containing solids" such as oil shale and tar sands, including diatomite, may be pyrolyzed in reactor vessels having various designs. Prior to being pyrolyzed the solids are usually reduced to a particulate material by crushing, grinding, etc. During this step, a substantial amount of fines are produced which are readily entrained by the stripping gas which is employed in the reactor vessel to carry off the product vapors. As a result, the attrition rate of these fines in the reactor vessel is usually very high, and the fines may be carried away from the pyrolysis zone before they have had the opportunity to completely release their hydrocarbons, i.e., before they are completely pyrolyzed. In most processes, the hydrocarbons contained in these unpyrolyzed or partially pyrolyzed fines are never recovered as product.

The present invention is directed to an improved process which makes it possible to recover the hydrocarbons in the fines which would normally be lost.

SUMMARY OF THE INVENTION

This invention concerns an improved process for pyrolyzing hydrocarbon-containing particles wherein fine particles containing unpyrolyzed hydrocarbons are entrained in the product vapors leaving the principal zone of pyrolysis, the improvement comprising:

(a) separating at least some of said fine particles from the product vapors;

(b) heating the separated fine particles in a supplemental pyrolyzing zone to pyrolyzing temperature for a time sufficient to pyrolyze the hydrocarbons in the fines;

(c) recovering the pyrolyzed hydrocarbons from the separated fine particles with a stripping gas, and (d) withdrawing the pyrolyzed fine particles from the supplemental pyrolyzing zone.

The improved process of this invention is particularly advantageous when the hydrocarbon-containing particles are oil shale. Oil shale, during the crushing and grinding operations preparatory to being pyrolyzed, produces a large amount of fines which are readily lost from the reactor vessel before they can be completely pyrolyzed. Processes such as those described in U.S. Pat. Nos. 4,199,432; 4,183,800; and 4,054,492, may be used to pyrolyze oil shale or other hydrocarbon-containing solids and are suitable for use with this invention.

The term "fines" or "fine particles," as used herein, refers to those particles of hydrocarbon-containing solids which are normally lost from the principal pyrolyzing zone with the product vapors and stripping gas. The size of these particles will vary with the details of the process. The higher the velocity of the stripping gas passing through the pyrolysis zone, the larger the size of particle which may be entrained. In a process such as that described in U.S. Pat. No. 4,199,432, particles smaller than about 200 mesh (Tyler Standard sieve) will normally become entrained in the stripping gas and product vapors leaving the top of the reactor vessel (retort).

DETAILED DESCRIPTION OF THE INVENTION

Figure 1:
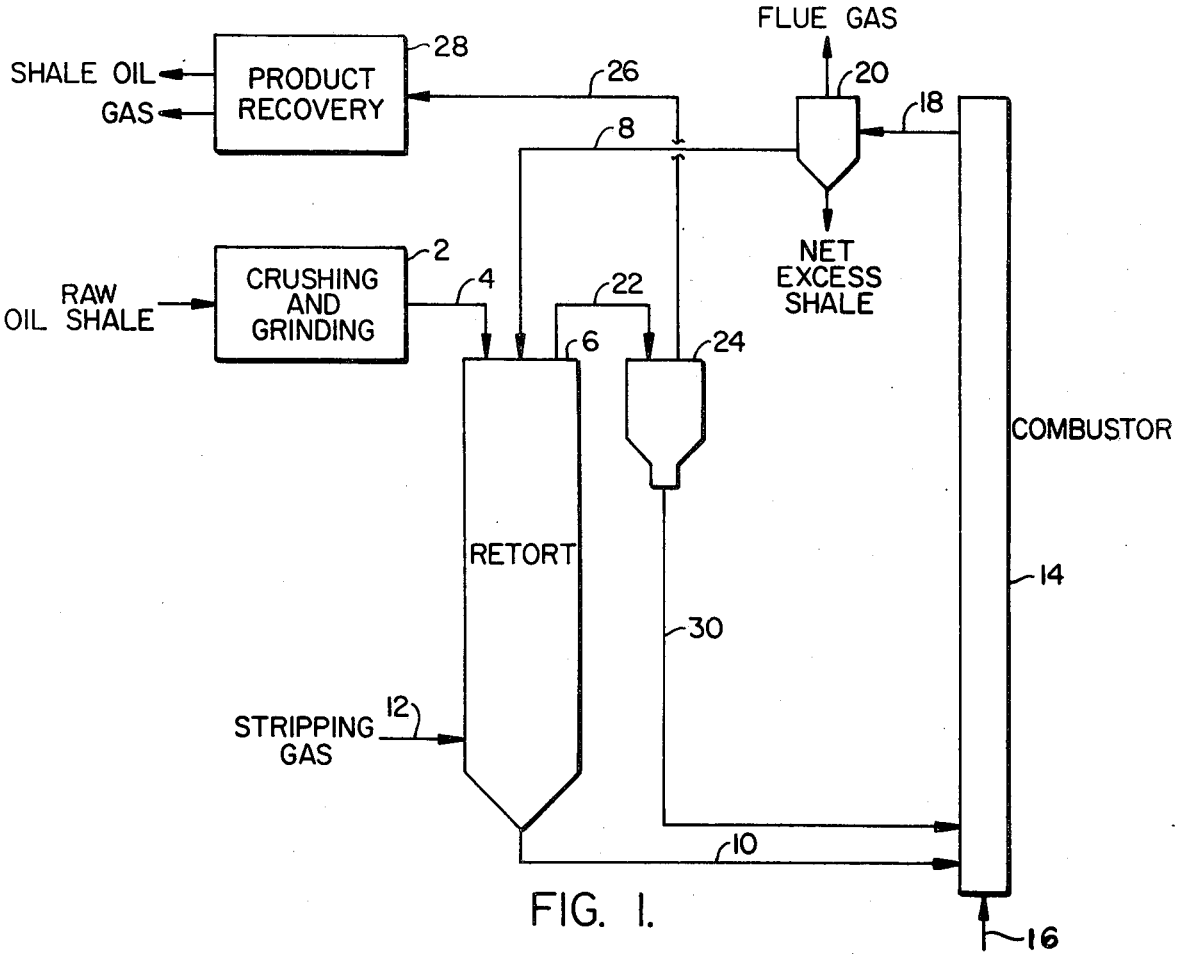
FIG. 1 is a schematic representation of an oil shale retorting (pyrolyzing) process suitable for use with the invention.

The process that is the subject of this invention will be further clarified by referring to FIG. 1 of the drawings which represents a process for retorting oil shale. With appropriate modification to accommodate other types of hydrocarbon-containing materials, the basic description of the figure will also illustrate how the invention may be used generally in a pyrolyzing process to recover the hydrocarbons from the fines.

Referring to FIG. 1, raw oil shale is crushed and ground in zone 2. The particle size to which the shale is reduced will vary depending on the details of the retorting process, but generally a maximum particle size of about $\frac{1}{4}$ inch in diameter is suitable for the type of process herein described. It should be understood that during the crushing and grinding operation, the shale is reduced to a mixture of different particle sizes—the largest particles having a diameter of about $\frac{1}{4}$ inch. About 2% to 5% of the shale will be reduced to particles of 200 mesh size (Tyler Standard sieve) or less.

After crushing and grinding, the oil shale will pass via conduit 4 to the retorting vessel 6 where the particles of raw oil shale are mixed with hot particles of heat carrier material (burned oil shale) entering through conduit 8. In the process herein described, the mixture of raw shale particles and heat carrier material forms a dense phase bed, which may or may not be fluidized. The bed of particles moves continuously downward and the pyrolyzed solids and heat transfer material are withdrawn from the bottom of the retorting vessel via conduit 10. A non-oxidizing stripping gas is introduced into the lower end of the retorting vessel via inlet 12. The raw shale is heated to a pyrolyzing temperature by the hot heat transfer particles, and the pyrolyzed hydrocarbons are carried away with the stripping gas. The pyrolyzed hydrocarbons, the stripping gas, and entrained fines are removed from the retorting vessel via outlet 22. The fine particles of oil shale which become entrained in the stripping gas are those having a terminal velocity equal to or below the superficial velocity of the stripping gas. As used herein, the term "terminal velocity" refers to the maximum velocity attained by a particle falling through a very long column of stagnant gas. Therefore, when the superficial velocity of the gas flow exceeds the terminal velocity of the particle, the particle will become entrained.

As noted above, various designs of retorting vessels may be employed to carry out the pyrolysis of the oil shale. Particularly preferred is a type of retorting vessel which utilizes a "staged turbulent bed." Such a retorting vessel is fully described in U.S. Pat. No. 4,199,432, the text of which is herein incorporated by reference. Briefly, such a vessel contains internal dispensing elements to substantially limit gross vertical backmixing of the solids in the bed. A different design of retorting vessel is described in U.S. Pat. No. 4,054,492, wherein a revolving screw is used to mix the raw shale and the heat carrier material in a mixing zone. The mixture then passes to a holding bin where the pyrolysis is completed. This process is also suitable for use with this invention.

Returning to FIG. 1, the mixture of pyrolyzed shale and heat carrier material leaving the bottom of the retorting vessel via conduit 10 passes to the combustor 14 where the residual carbon that remains in the pyrolyzed shale is burned. The combustor illustrated is a liftpipe into which a stream of air is introduced via air inlet 16. The particles of shale are entrained and carried upward. The residual carbon left in the pyrolyzed shale serves as fuel to heat the particles of shale to a temperature sufficient that they may be recycled to the retort as heat carrier particles. The hot particles of shale and flue gas from the combustor exit via conduit 18 and pass to a separation zone 20. In the separation zone, the flue gas is separated from the hot burned particles of shale. In addition, fine burned shale and excess burned shale not required as heat carrier material are removed from the process and designated net excess shale on the figure. Coarse grained particles of hot burned shale that will be recycled as heat carrier material is carried back to the retort via conduit 8.

As noted above, the stripping gas, hydrocarbon vapors, and entrained fines are carried away from the retorting vessel via outlet 22. These pass to the fines removal and supplemental retorting zone 24. In this zone, the fines are removed from the gaseous components by a separation means such as a cyclone, electrostatic precipitator or the like. The gas passes via conduit 26 to the product recovery zone 28 where the shale oil is separated from the other gases. The fines which remain in the fines removal and supplemental retorting zone 24 are heated to pyrolyzing temperature for a time sufficient to pyrolyze the hydrocarbons remaining in the fines. In the case of oil shale, this temperature will usually be in the range of from about 850° F. to about 1000° F., with the preferred temperature being in the range of from about 900° F. to about 950° F. The hydrocarbons released by the pyrolysis of the fines are carried off with the stripping gas and hydrocarbon vapors leaving via conduit 26. The pyrolyzed fines are carried via fines conduit 30 to the combustor where any residual carbon is burned off.

Figure 2:
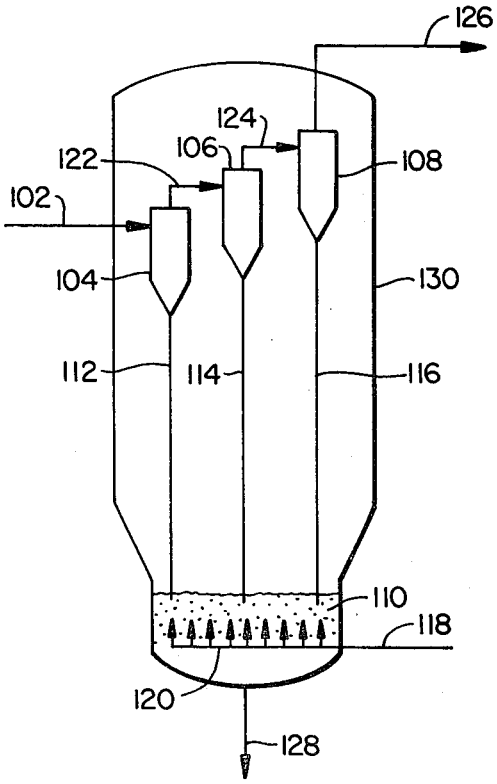
FIG. 2 is a representation of a supplemental retorting vesel which may serve as a supplemental pyrolysis zone for oil shale.

Referring to FIG. 2, a supplemental retorting vessel is diagrammed which may be employed as the fines removal and supplemental retorting zone designated as 24 in FIG. 1. In this embodiment, the stripping gas, hydrocarbon vapors, and entrained fines enter via inlet 102 which carries them to a series of cyclones designated as 104, 106, and 108. In each successive cyclone, additional fines are removed from the entraining gas and sent to a fluidized bed 110 by means of diplegs 112, 114, and 116 from the cyclones 104, 106, and 108, respectively. The bed of fines is fluidized by a hot, non-oxidizing, fluidizing gas which enters via conduit 118 and is distributed by gas distribution ring 120. In addition to fluidizing the bed of fines, the gas, preferably superheated steam, raises the fines to pyrolyzing temperature. The retort gases from which the fines were removed pass to the successive cyclones via conduits 122 and 124, respectively. The gases leave the supplemental retort via outlet 126 which carries them to the product recovery zone. The fines remain in the fluidized bed 110 for a time sufficient to pyrolyze any remaining hydrocarbons. Usually a residence time of about three minutes is sufficient to pyrolyze the fines using the supplemental retort described. The pyrolyzed fines are drawn off via conduit 128 and sent to the combustor.

The pyrolyzed hydrocarbons and fluidizing gas from the fluidized bed are recycled to the inlet 102 and mixed with the retort gases and fines entering from the principal retorting zone. This is readily done by holding the containment vessel 130 at a slightly higher pressure from that in cyclones 104, 106, and 108.

I claim:

1. A process for pyrolyzing a particulate hydrocarbonaceous solid containing a fraction of fine particles of entrainable size and a fraction of coarse particles having a particle size too large to be entrained which comprises:

(a) heating the hydrocarbonaceous solid to a pyrolyzing temperature in a first pyrolysis zone by mixing the hydrocarbonaceous solid with a hot particulate heat transfer material of non-entrainable size in a dense phase bed through which a stripping gas is passed at a superficial velocity sufficient to carry away product vapors and to entrain said minor fraction of fine particles but insufficient to entrain the fraction of coarse particles;

(b) separating at least some of said fine particles from the product vapors;

(c) pyrolyzing the separated fine particles in a second pyrolysis zone containing a bed of fine particles substantially free of coarse particles, said bed of fines being fluidized by a hot non-oxidizing gas; and (d) recovering separately from the second pyrolysis zone additional product vapors and pyrolyzed fine solids.

2. The process of claim 1 wherein the hydrocarbon-containing particles are oil shale particles.

3. The process of claim 2 wherein the fines are heated to a temperature of between about 850° F. and 1000° F.

4. The process of claim 3 wherein the temperature is between about 900° F. and 950° F.

5. The process of claim 1 wherein the dense phase bed in the first pyrolysis zone is a staged turbulent bed.

* * * * *